United States Patent [19]

Lerch et al.

[11] 4,217,192

[45] Aug. 12, 1980

[54] DECONTAMINATION OF METALS USING CHEMICAL ETCHING

[75] Inventors: Ronald E. Lerch, Kennewick; Jerry A. Partridge, Richland, both of Wash.

[73] Assignee: The United States of America as represented by the United States Department of Energy, Washington, D.C.

[21] Appl. No.: 47,446

[22] Filed: Jun. 11, 1979

[51] Int. Cl.[2] ..... C23G 1/08; C25C 1/00

[52] U.S. Cl. ..... 204/149; 134/3; 134/13; 134/41; 204/97; 204/130

[58] Field of Search ..... 204/180 P, 149, 152, 204/130, 97, 89, 86, 105 R, 112; 148/12 E, 37; 134/3, 2, 10, 13, 41, 29

[56] References Cited

U.S. PATENT DOCUMENTS

| | | | |
|---|---|---|---|
| 3,437,521 | 4/1969 | Buist | 134/2 X |
| 3,496,017 | 2/1970 | Weed | 134/41 X |
| 3,615,817 | 10/1971 | Jordan et al. | 134/3 |
| 3,640,805 | 2/1972 | Knight et al. | 204/130 |
| 3,682,796 | 8/1972 | Dev Bedi et al. | 204/97 |
| 3,821,091 | 6/1974 | Bilal et al. | 204/180 P X |
| 3,840,646 | 10/1974 | Sugimoto et al. | 134/13 X |
| 3,873,362 | 3/1975 | Mihram et al. | 134/13 X |
| 4,006,067 | 2/1977 | Gussack | 204/149 X |
| 4,162,206 | 7/1979 | Burger et al. | 204/149 X |

OTHER PUBLICATIONS

Lerch, "Oxidation of Cerium (III) by Ozone and by Electrolysis" AEC Research & Devel. Report, BNNL-805, (8-1968).

Horner et al., "Cerium-Promoted Dissolution of $PuO_2$ and $PuO_2$-$U0_2$ in Nitric Acid", Oak Ridge National Lab Report, ORNL/TM-4716 District Category UC-79C (8-1977).

*Primary Examiner*—Arthur C. Prescott

*Attorney, Agent, or Firm*—R. V. Lupo; Richard E. Constant; Robert Southworth

[57] ABSTRACT

The invention relates to chemical etching process for reclaiming contaminated equipment wherein a reduction-oxidation system is included in a solution of nitric acid to contact the metal to be decontaminated and effect reduction of the reduction-oxidation system, and includes disposing a pair of electrodes in the reduced solution to permit passage of an electrical current between said electrodes and effect oxidation of the reduction-oxidation system to thereby regenerate the solution and provide decontaminated equipment that is essentially radioactive contamination-free.

10 Claims, 1 Drawing Figure

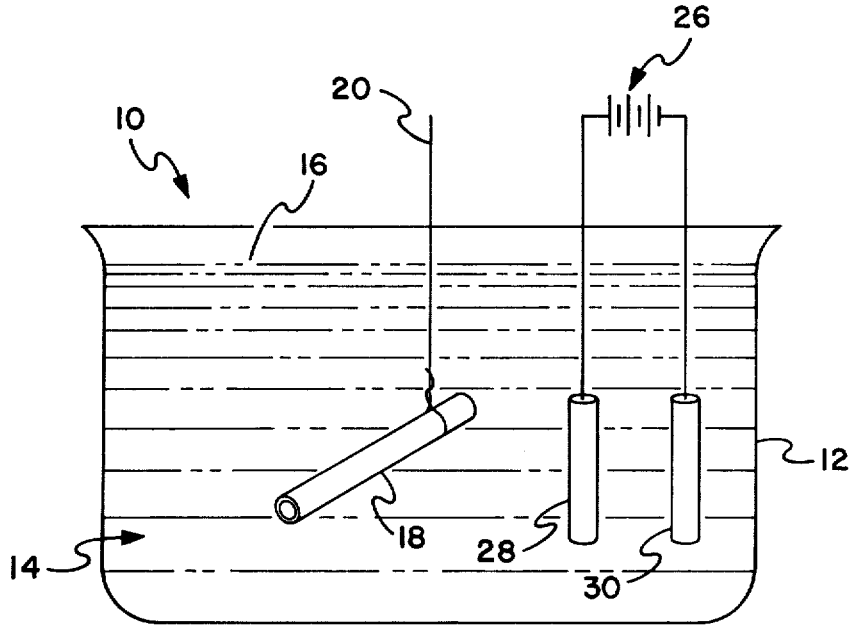
26
20
10
16
12
18
28
14
30

DECONTAMINATION OF METALS USING CHEMICAL ETCHING

This invention was made in the course of, or under, a contract with the U.S. Department of Energy.

BACKGROUND OF THE INVENTION

The invention relates to the system and method for the decontamination of radiation contaminated equipment.

Stainless steel is widely used throughout the nuclear industry as a structural material and/or in equipment used for processes contacting nuclear materials. During such uses, the material or equipment can become grossly contaminated with radionuclides as is known in the art such that its usefulness is impaired. Primary contaminants might include: plutonium, americium, uranium and mixed fission products including cerium-144, ruthenium-106, cesium-137 and silver-110m. The equipment must then either be decontaminated, i.e., cleaned, stripped or the like of radionuclides, so that it can be returned to service or be disposed of by dismantling into small volumes for long term storage by burial or in a geologic repository. Failed equipment constitutes a large volume of contaminated radioactive waste which takes up a large volume of storage space, and is difficult to handle due to its radionuclide contamination. The ability to remove the contamination from the surfaces of metal equipment would greatly reduce the amount of waste requiring geologic disposal on the like and the costs associated with such disposal and monitoring of radioactive waste.

Recognizing the problem that this poses, a variety of cleaning solutions have been investigated for use in decontaminating equipment used in the nuclear industry. These solutions have included permanganate, oxalic acid, various detergents, inhibited mineral acids, and chelating agents as well as very corrosive materials like sulfuric acid, phosphoric acid, and hydrochloric acid, and combinations of other solutions. While these cleaning solutions worked to various degrees and can be used to decontaminate nuclear industry equipment to a certain extent, various problems still remain. Similarly, work is currently being done on using electrolysis in a phosphoric acid solution as a technique to decontaminate metals. This electrolysis is accomplished by making the metal piece to be decontaminated the anode and using a 40 to 80% phosphoric acid as a conductor or electrolyte. While this electrolytic process does have the advantage that it effectively decontaminates areas which are inaccessible to normal decontamination agents, it does have the drawback of employing solutions that cannot be easily regenerated, and it creates large volumes of high salt content liquid waste solutions with respect to the amount of material processed. Another disadvantage of this process is that the degree of decontamination of the piece of equipment is sensitive to the position of the cathode relative to the surface of the equipment.

SUMMARY OF INVENTION

In view of the above problems and disadvantages of the prior art, it is an object of this invention to provide a method for radioactive decontamination of equipment.

It is a further object of this invention to provide a process for decontaminating stainless steel which has been grossly contaminated with radionuclides.

It is a further object of this invention to provide a process employing a cerium(III)-cerium(IV)-nitric acid solution for the decontamination of radionuclides on stainless steel.

It is a further object of this invention to provide a process for decontaminating equipment which is grossly contaminated with radionuclides employing an inorganic system wherein the decontaminating solution employs an inorganic reduction-oxidation system.

It is a further object of this invention to provide a process for decontaminating equipment contaminated with radionuclides wherein the active member of the solution may be regenerated by electrolysis during the decontamination cycle.

It is a further object of this invention to provide a process for decontaminating and reclaiming readioactively contaminated equipment, using an inorganic reduction-oxidation system, and regenerating the oxidant in the system to maximize the dissolution of radionuclides into the solution.

Various other objects and advantages will appear from the following description of this invention and the most novel features will be particularly pointed out hereinafter in connection with the appended claims. It will be understood that various changes in the details, materials and steps of the process, which are herein described and illustrated in order to explain the nature of the invention, may be effected by those skilled in the art without departing from the scope of this invention.

The invention comprises, in brief, contacting metals contaminated with radionuclides with an inorganic reduction-oxidation system to accomplish decontamination of the metals by said system. Inorganic reduction-oxidation systems that are useful include cerium(IV)-cerium(III) in nitric acid, chromium (VI)-chromium-(III) in nitric acid, silver(II)-silver(I) in nitric acid, and cobalt(III)-cobalt(II) in nitric acid. Other reduction-oxidation systems in other acids may be included as long as the system may exist in two different oxidation states in the acid. It is desirable to regenerate the oxidant by electrolysis.

DESCRIPTION OF DRAWING

The drawing illustrates a typical apparatus for the process and system of this invention.

DETAILED DESCRIPTION

Corrosion of stainless steel and other metals such as mild steel, and black iron in nitric acid or other acids such as sulfuric acid or hydrochloric acid can be accelerated by the presence of certain inorganic reduction-oxidation (redox) systems. These are systems which contain elements capable of existing in two different oxidation states in the nitric acid or the acid being used. Examples of reduction-oxidation systems which can exist in nitric acid are cerium(IV)-cerium(III), chromium(VI)-chromium(III), silver(II)-silver(I), and colbalt-(III)-cobalt(II).

This invention is specifically directed to the use of such inorganic reduction-oxidation systems for decontaminating radioactively contaminated metals encountered in the nuclear industry, and specifically where the systems are in nitric acid. Regeneration of the oxidant by electrolysis is included in this invention for the decontamination process. Decontamination is accomplished by dissolution of the surface of the metal piece that is being decontaminated when it is in contact with solution. The invention described herein is directed to the chemical decontamination of the metal parts or pieces and not to any electrolytic decontamination of the contaminated components.

The requirement for decontamination exists not only because some equipment may be salvaged, but also because plutonium contaminated substances must be decontaminated, and if equipment that is grossly contaminated can have the contamination reduced to low levels, the equipment can be cut up for repackaging into much smaller volumes for disposal or storage.

As shown in the drawing, the apparatus 10 includes a container 12 forming a chamber 14 having a solution 16 disposed therein. Solution 16 may be a nitric acid solution containing a reduction-oxidation system as described herein. Pipe 18 is suitably suspended or otherwise immersed in solution 16 by hanger 20 or the like. The radioactive contamination of pipe 18 is significantly reduced by chemical reaction of the immersed surfaces of pipe 18 with solution 16, resulting in reduction of the reduction-oxidation system as described herein. A suitable power source, such as a battery 26, may be used to create an electric circuit between anode 28 and cathode 30 through solution 16 thereby effecting oxidation of the reduced member of the reduction-oxidation system as is known in the art.

Various runs were made using this invention with a cerium(IV)-cerium(III) system in nitric acid. Runs were conducted in solutions wherein the nitric acid was at from about 2 to about 8 Molar(M), the cerium ion was about from 0.1 to 0.3 M, the temperature variation was from about 20° C. to about 100° C. and the electric current to regenerate cerium(IV) was at a current of from 0.5 to 1.5 amps.

The maximum dissolution rate for stainless steel (type 300 series) was achieved in 7 M nitric acid −0.25 M cerium(IV) at 90° C. using 0.5 amperes current to regenerate the cerium(IV). The maximum dissolution rate was 1.5 mils per hour or 29 milligrams per square centimeter per hour. It is to be understood that various other changes may be made by the practitioner to these parameters without departing from the scope of this invention and achieving equal or better results. For example, any suitable current which maintains a high cerium(IV)/cerium(III) ratio may be used.

In one run, a ½ inch stainless steel (Type 304) tubing which was immersed approximately 2 inches into a 0.2 M cerium(IV)-4 M nitric acid solution at 80° C. for 10 minutes was partially etched removing surface layers. In another run, a 3½ inch diameter stainless steel pipe cap after having been partially immersed in a 0.1 M cerium(IV)-4 M nitric acid solution at 80° C. for 50 minutes had a heavy dark corrosion layer on it removed after having been used in a test in which it was heated in a furnace at 1100° C. for two hours. From our analysis, it is obvious that the cerium(IV) solution had attacked the oxide layer and metal surface of both pieces of stainless steel. While the cerium(IV)-cerium(III) system in nitric acid has been described and illustrated, it is to be understood that the various other inorganic reduction-oxidation systems which were described herein may be employed. Examples of reduction oxidation systems which can exist in nitric acid include cerium(IV)-cerium(III), chromium(VI)-chromium(III), silver(II)-silver(I) and cobalt(III)-cobalt(II).

The chemical systems described herein have advantages over the prior art. Nitric acid solutions are widely used throughout the nuclear industry and as such their properties are well known and understood. This facilitates cleanup of the decontamination solution (for example by removal of plutonium and/or other contaminants) by standard chemical separation techniques used routinely in the nuclear industry such as ion exchange or solvent extraction, and/or disposal of the solution following its use as a decontamination agent.

The cerium(IV)-cerium(III) system in nitric acid described herein is a good dissolution agent for plutonium oxide and could be used for removal or recovery of plutonium from equipment highly contaminated with plutonium. In addition, other reduction-oxidation systems as described herein may be used for the dissolution of plutonium dioxide.

The systems as noted herin are low salt systems and therefore there is potentially less waste generated by this process than other processes. In addition, the decontamination is not sensitive to relative distance from an electrode as in electrolytic processes. Thus the process is more effective for irregularly shaped equipment than an electrolytic process which is sensitive to the location of the cathode relative to the piece to be decontaminated. While immersion has been described herein, the process does not require immersion for the equipment being decontaminated. This process would be just as effective by a spray or a flowthrough system.

We claim:

1. A process for reclaiming radiation contaminated equipment by removing radioactive contaminants from metal surfaces of said equipment comprising preparing a solution of nitric acid containing a reduction-oxidation system, wherein said reduction-oxidation system may be reduced and subsequently reoxidized by electrolysis, heating said solution, contacting the metal to be decontaminated with said solution, said contacting effecting a chemical reaction reducing said reduction-oxidation system to the reduced state, disposing a pair of electrodes in said solution, passing an electrical current between said electrodes thereby regenerating the oxidized state and thereby regenerating said solution, said contact of said metal with said solution effectively removing said radioactive contaminants from said metal surfaces, and subsequently removing said metal from said solution as an essentially radioactive contaminant-free metal.

2. The process of claim 1 wherein said reduction-oxidation system is selected from the group consisting of cerium(IV)-cerium(III), chromium(VI)-chromium(III), silver(II)-silver(I), and cobalt(III)-cobalt(II).

3. The process of claim 1 wherein said reduction-oxidation system comprises cerium(IV)-cerium(III), said contacting of said metal to be decontaminated with said solution effects a chemical reduction of said cerium(IV) to cerium(III), and said passage of said electrical current between said electrodes oxidizes said cerium(III) to cerium(IV).

4. The process of claim 3 wherein said electrolytic regeneration of cerium (IV) is accomplished by passing about 0.5 amperes current between said electrodes.

5. The process of claim 3 wherein said metal contact with said solution accomplishes a dissolution rate of said metal of about 29 milligrams per square centimeter per hour.

6. The process of claim 3 wherein said nitric acid is at a molar concentration of from about 1 molar to about 8 molar and said cerium(IV) is at a concentration range of from about 0.01 molar to about 0.30 molar.

7. The process of claim 6 wherein said nitric acid has a concentration of about 7 molar and said cerium(IV) has a concentration of about 0.25 molar to achieve a dissolution rate of about 29 milligrams per square centimeter per hour.

8. The process of claim 6 wherein said nitric acid has a concentration of 7 molar, said heating is at about 90° C. and said cerium(IV) has a concentration of about 0.25 molar in the (IV) oxidation state.

9. The process of claim 1 wherein said heating is to from about 20° C. to about 100° C.

10. The process of claim 9 wherein said heating is at about 90° C.

* * * * *